US006053727A

United States Patent [19]

Potskhishvili et al.

[11] Patent Number: 6,053,727

[45] Date of Patent: Apr. 25, 2000

[54] GAS LIGHTER WITH SAFETY DEVICE

[76] Inventors: David Vakhtangovich Potskhishvili, B. Gruzinskaya, d.40, str.1, kv.19, Moskva, Russian Federation, 123056; Karlo Vakhtangovich Potskhishvili, Gldanskiy massiv II m.r.k.28. kv.73, Tbilisi, Georgia, 380038

[21] Appl. No.: 09/379,632

[22] Filed: Aug. 24, 1999

[51] Int. Cl.[7] ..... F23D 11/36

[52] U.S. Cl. ..... 431/153; 431/277

[58] Field of Search ..... 431/153, 276, 431/277

[56] References Cited

U.S. PATENT DOCUMENTS

| | | | |
|---|---|---|---|
| 5,096,414 | 3/1992 | Zellweger | 432/277 |
| 5,547,370 | 8/1996 | Hwang | 431/276 |
| 5,868,561 | 2/1999 | Rogelet | 431/153 |
| 5,971,749 | 10/1999 | Chen | 431/153 |

FOREIGN PATENT DOCUMENTS

| | | |
|---|---|---|
| 0357347 | 11/1993 | European Pat. Off. . |
| 0611096 | 8/1994 | European Pat. Off. . |
| 0482411 | 6/1995 | European Pat. Off. . |
| 2304879 | 3/1997 | United Kingdom . |
| WO90/00239 | 1/1990 | WIPO . |
| WO90/12254 | 10/1990 | WIPO . |

*Primary Examiner*—Carroll Dority
*Attorney, Agent, or Firm*—Jacobson, Price, Holman & Stern, PLLC

[57] ABSTRACT

The invention relates to the field of energy and is directed to a child-proof gas lighter, i.e. the gas lighter in which means for spark-forming neutralization are combined with a gas ignition mechanism. The gas ignition means comprises a gearwheel secured to a spigot and corrugated wheels positioned on a shaft which has a central portion on which the gearwheel is loosely positioned and which is formed as a polyhedron, and end portions to which the corrugated wheels are secured and which are cylindrical and are disposed within openings of brackets of the lighter body or of a holder of a spring-pressed flint. The shaft is mounted within the bracket openings so as to move along a direction of the flint spring action. An opening of the gearwheel is polyhedral, whereby a maximum diameter of the shaft in the area of the gearwheel installation is less than a minimum diameter of the opening of the gearwheel spigot. The lighter also has a support secured to the body or to a control lever, which support encircles the flint and is located between the corrugated wheels to bear the gearwheel when the shaft moves within the bracket openings toward the flint in a spark striking position. Whereby, in the absence of a force on the corrugated wheels, a gap is formed between the gearwheel spigot and the support the size of which gap is less than the stroke of the shaft end portions within the bracket openings.

1 Claim, 3 Drawing Sheets

GAS LIGHTER WITH SAFETY DEVICE

BACKGROUND OF THE INVENTION

The present invention relates to the field of energy and is directed to a child-proof gas lighter, i.e. the lighter provided with a means for neutralizing ignition elements being movable between an operating neutralizing position wherein no spark is struck on activating an ignition mechanism and a position wherein it is possible to produce the spark required to ignite the gas.

Lighters of this type are known which are described in GB, No.A-2304879, U.S. Pat. Nos. 5096414, 5547370, 5868561 and in which a gas ignition device includes a gearwheel positioned on a shaft and firmly connected with it, corrugated wheels rotatably positioned on said shaft by the sides of the gearwheel, a flint pressed toward the gearwheel, whereby said shaft has side portions on which the corrugated wheels are located and formed as a polyhedron, and end portions which are cylindrical and disposed in the openings of brackets of the lighter body. A maximum diameter of the shaft in the area where the corrugated wheels are mounted is less than a minimum diameter of the opening of these wheels.

When the corrugated wheels are classically acted upon, they turn about the shaft which precludes striking a spark since the gearwheel does not rotate. To ignite the gas exiting from the lighter burner valve, it is necessary to depress the corrugated wheels, to force them into contact with the shaft edges and to turn the wheels in conventional manner. Due to friction appearing when the corrugated wheels and the shaft interact in the contact area, the shaft and the gearwheels sitting therein can turn.

Safety devices described in the patents do not require any additional buttons and lever movements in order to achieve the goal which makes them more attractive as compared to other lighters. The only thing required from a user is to more attentively and with a determined force depress the corrugated wheels, otherwise they would rotate idly.

However, due to the fact that the corrugated wheels rotate about the shaft independently of each other, the user not always is able to select the force needed to turn the gearwheel. In certain cases, the both corrugated wheels operate in time but sometimes, only one. Therefore, the user now easily lights the lighter, now with some difficulty.

With all classical lighters, the spark striking device is of at integral design. The above-mentioned inventions lack this feature. Here the spark striking wheel consists of a plurality of loosely interconnected parts. This makes it difficult to assemble and repair the lighter and in the event the lighter drops, there is a risk to lose some parts.

BRIEF DESCRIPTION OF THE INVENTION

The object of the present invention is to provide a child-proof gas lighter having equivalent operating safety and a more simple and technologically feasible design due to the fact that a gas ignition means provided with a function of safety device presents an independent assembly module which is maximally close to the classical integral design which enable to substantially reduce the time for lighter assembly and, if required, for its repair.

Indeed, in a gas lighter designed to prevent children from igniting the lighter, comprising a gas ignition device which includes a shaft-mounted gearwheel, corrugated wheels positioned on said shaft at the sides of the gearwheel, a flint pressed by a spring toward the gearwheel, said shaft having a central portion on which the gearwheel is placed and which is formed as a polyhedron, and end portions which are cylindrical and disposed within openings of the bracket of the lighter body or a holder of the spring-pressed flint, the corrugated wheels are rigidly linked to the shaft which is mounted within the bracket openings so as to move along a direction of the flint spring action, an opening of the spigot of the gearwheel is made polyhedral, the gearwheel is mounted on the spigot and rotatably installed on said shaft, whereby a maximum diameter of the shaft in the area of gearwheel installation is less than a minimum diameter of the opening of the gearwheel spigot, it is provided with a support secured on the body or on a control lever encompassing the flint and disposed between the corrugated wheels for bearing the end portions of the gearwheel spigot when the shaft moves within the bracket openings toward the flint in a spark striking position, wherein when a pressure is absent on the corrugated wheels, a gap is formed between the gearwheel spigot and the support the amount of which is less than the stroke of the shaft end portions within the bracket openings.

DETAILED DESCRIPTION OF THE DRAWINGS

The present invention is illustrated with the following drawings which represent the preferred embodiment according to each variant but are not single but demonstrate the possibility to achieve the desired result by totality of essential features set forth in the claims.

DETAILED DESCRIPTION OF THE INVENTION

Figure 5:
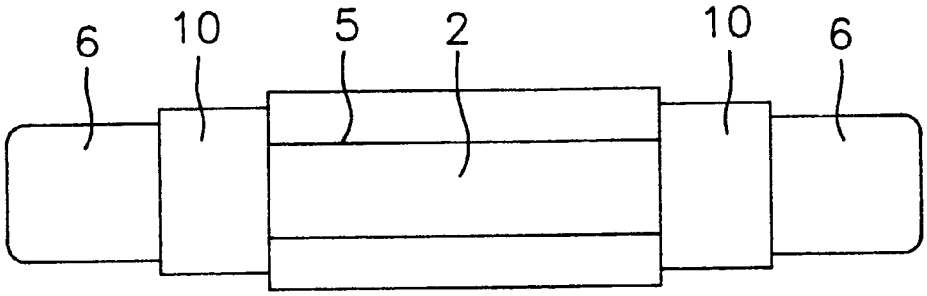
FIG. 5 is a general view of the shaft.
Figure 6:
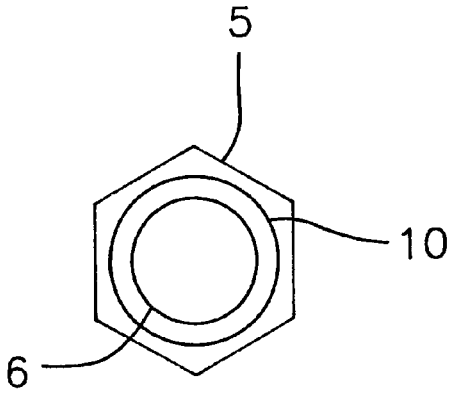
FIG. 6 is an end view of the shaft of FIG. 5.

A gas lighter with a safety device designed to prevent the possibility of children igniting the lighter comprises a gas ignition means (FIG. 1) including a gearwheel 1 positioned on a shaft 2, corrugated wheels 3 disposed on said shaft 2 at the sides of the gearwheel 1, a flint 4 spring-pressed toward the gearwheel 1. The shaft 2 (FIGS. 5, 6) has a central portion 5 on which the gearwheel is positioned and which is formed as a polyhedron, and end portions 6 which are cylindrical and are rotatably located within openings 7 of brackets 8 of the lighter body 9 or a holder of the spring-pressed flint.

The corrugated wheels 3 are rigidly linked to the shaft at the portion 10, while the shaft 2 is located within the openings 7 of the brackets 8 so as to move along a direction of the flint 4 spring action. The openings 7 (FIG. 1) have an elongated shape to form a gap 11 between a wall of the opening 7 and a surface of the end portion 6 of the shaft 2.

Figure 1:
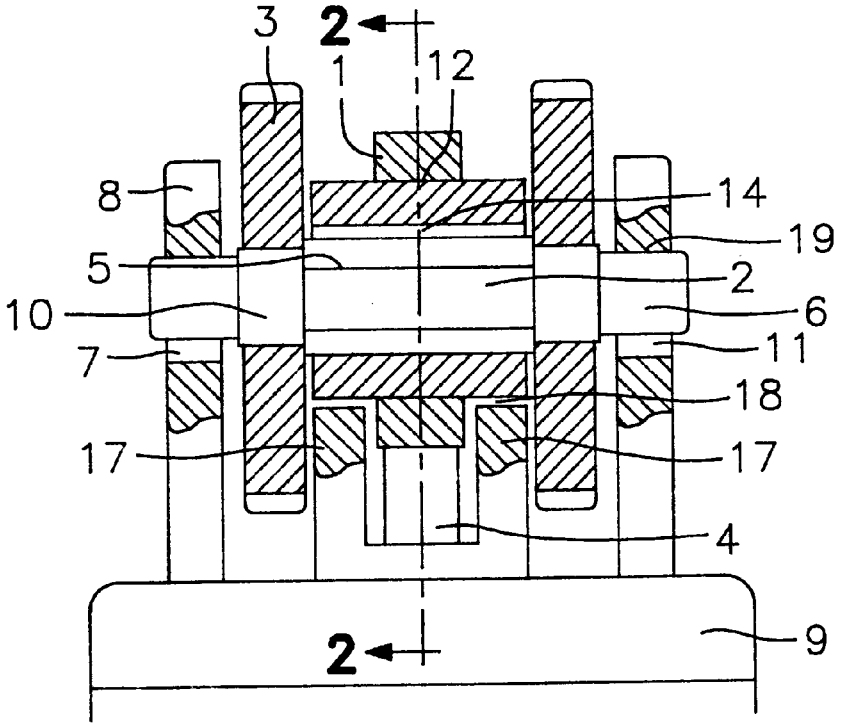
FIG. 1 is a general view of the gas ignition means with initial position of elements (spark-forming neutralization mode)

The gearwheel 1 is formed either integral with the spigot 12 or rigidly sits on this spigot. The length of the spigot is greater than the thickness of the gearwheel so that the end portions 13 of the spigot can protrude at the sides of the gearwheel. The opening of spigot 12 of the gearwheel 1 is polyhedral, and the spigot itself, together with the gearwheel, is rotatably mounted on this shaft. In order to solve the problem of jointly turning the spigot and shaft when the shaft and the opening of the spigot 12 are polyhedral in the cross-section, it is necessary that a maximum diameter of shaft 2 in the area of mounting the gearwheel 1 is less than a minimum diameter of the opening of spigot 12 of gearwheel 1. As seen in FIG. 1, this condition is met due to the presence of the gap 14 between edges 15 of shaft 2 and edges 16 of the opening of spigot 12. This gap has its maximum in the direction of the flint spring action (FIG. 2).

Figure 4:
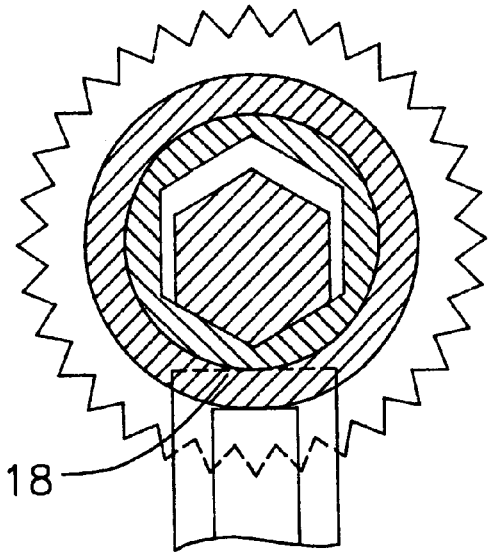
FIG. 4 is a side view of the ignition means of FIG. 3 when the user depresses the corrugated wheels in order to strike a spark, section B—B in FIG. 3.
Figure 7:
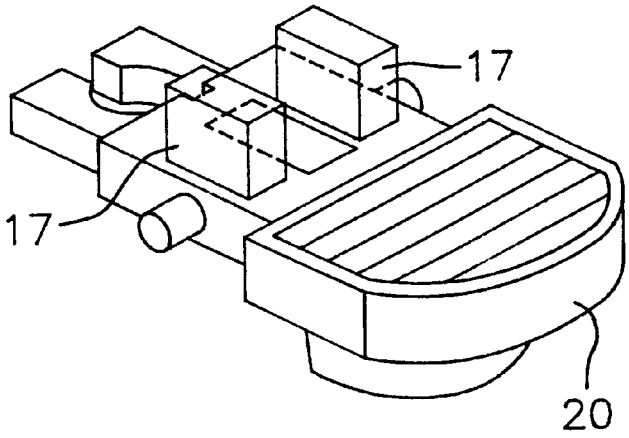
FIG. 7 is a view of the control lever with the support 17.

The lighter has a support 17 secured to the body or to the control lever 20 (FIG. 7). Support 17 encircles the flint 4 and is positioned between corrugated wheels 3. The support serves for bearing end portions 13 (FIG. 4) of spigot 12 of gearwheel 1 when the shaft 2 moves within the bracket openings toward the flint in the spark striking position.

Figure 2:
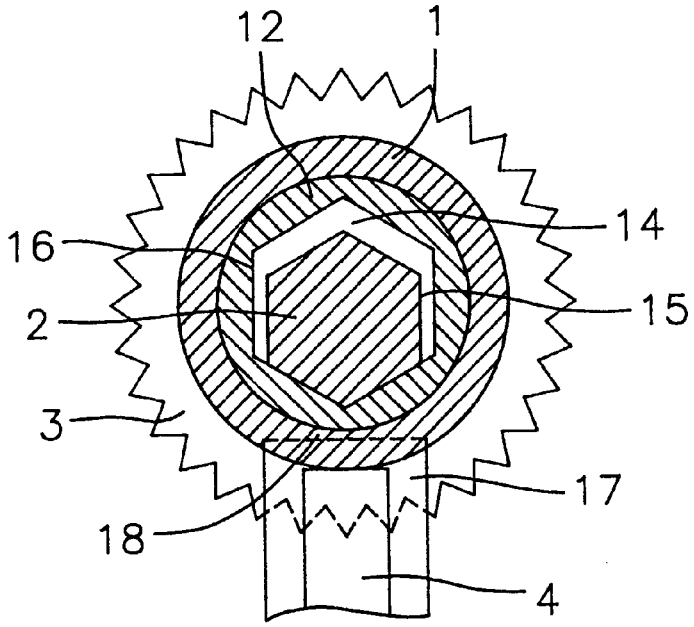
FIG. 2 is a side view of the ignition means of FIG. 1 in the spark-forming neutralization mode, section A—A in FIG. 1.

Whereas in the absence of any force on the corrugated wheels 3, the gap 18 is formed between the spigot of gearwheel 1 and support 17 the size of which is less than the stroke of the shaft end portions within the bracket openings (FIG. 2).

The gas ignition means of this invention is assembled as follows.

Shaft 2 (FIG. 5) has several special portions on which other parts are threaded. On the first portion 10 of shaft 2 a first corrugated wheel 3 is threaded fittingly (without the possibility of rotation). Further, the gearwheel 1 with spigot 12 having a shaped opening is threaded on shaft 2. Further, a second corrugated wheel 3 is fittingly threaded on the second portion 10 of shaft 2. According to FIGS. 2 and 4, the opening of spigot 12 and the central portion 5 of shaft 2 are regular hexagons (in cross-section). Their dimensions are selected so that the gearwheel 1 with spigot 12 can freely rotate about shaft 2.

The shapes of the shaft polyhedrons and of the spigot opening are not so essential for the present invention and may be more varied than those provided in the present invention. This may be any regular or irregular polyhedron or another geometrical figure having breaks along the perimeter of the outline which would provide contact interaction by friction between the spigot and shaft.

After assembly, the shaft 2 is installed with end portions 6 entering into the bracket 8 openings (ears) of the lighter body 9.

Gearwheel 1 fittingly (without the possibility of rotation) sits on spigot 12.

Flint 4 pressed by a spring (not shown) bears against the gearwheel 1 and reduces the gap down to zero in the lower part of the spigot opening and the surface of shaft 2 at the central portion 5.

Gap 19 between the end portions 6 of shaft 2 and the opening in bracket 8 is also reduced to zero. In this situation, gap 14 in the upper part between shaft 2 and the walls of openings in spigot 12 reaches its maximum.

In this invention, the support 17 plays the key role. It may be located on the body 9 (FIG. 1) or on the control lever 20 (FIG. 7). It is positioned between the flint 4, gearwheel 1 and corrugated wheels 3. In the normal position (FIG. 1), the gap 18 between the support 17 and spigot 12 has its maximum. Gap 11 also has its maximum.

When the user depresses the corrugated wheel 3 (FIG. 3), the gap 14 does not vary. Only the sizes of the gaps 19, 11 and 18 change.

Figure 3:
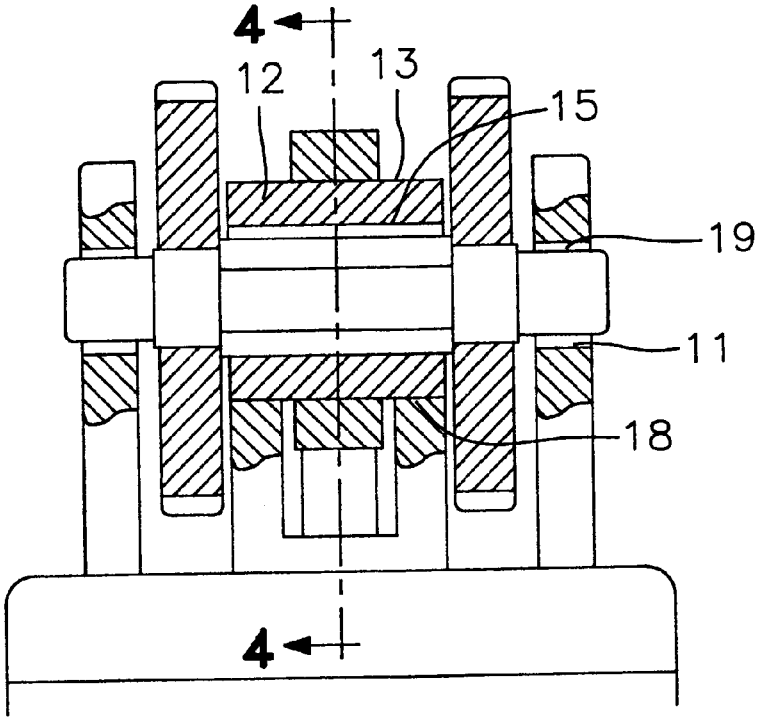
FIG. 3 is a general view of the gas ignition means showing the position of elements when a user depresses the corrugated wheels in order to strike a spark.

The opening in the bracket 8 is selected of such dimension that when the gap 18 is equal to zero, the gap 11 is not equal to zero (FIG. 3).

Consequently, by depressing the corrugated wheel 3, the user can select a force, after having turned spigot 12 with gearwheel 1 about flint 4, therereby the end portions of spigot 12 would turn along the surface of support 17. In this case, a spark is struck and the lighter can be lighted.

Since the corrugated wheels 3 are rigidly connected with shaft 2 at portions 10, the user is able to light the lighter with a uniform habitual force which is not always possible in the solutions disclosed in the known patents.

We claim:

1. A gas lighter with safety device designed to prevent the possibility of children igniting the lighter comprising:

gas ignition means including a gearwheel placed on a shaft;

corrugated wheels positioned on said shaft at the sides of said gearwheel;

a flint spring-pressed toward the gearwheel;

whereby said shaft has a central portion on which said gearwheel is positioned and which is formed as a polyhedron, and end portions which are cylindrical and are rotatably positioned within openings of brackets of the lighter body or of a holder of the spring-pressed flint;

said corrugated wheels are rigidly linked to the shaft which is mounted within the bracket openings so as to move along a direction of the flint spring action;

said gearwheel is mounted on s spigot or is integral with it and is rotatably installed on said shaft, the spigot having a polyhedral opening;

a maximum diameter of said shaft in the area of said gearwheel installation is less than a minimum diameter of the opening of said gearwheel spigot;

a support secured to the body or to a control lever, said support encircling the flint and is located between said corrugated wheels to bear the end portions of said gearwheel spigot when said shaft moves within the bracket openings toward the flint in a spark striking position;

whereby, in the absence of a force on said corrugated wheels between said gearwheel spigot and said support a gap is formed whose size is less than the stroke of the end portions of said shaft within said bracket openings.

* * * * *